US005253013A

United States Patent [19]

Takano et al.

[11] Patent Number: 5,253,013

[45] Date of Patent: Oct. 12, 1993

[54] IMAGE RECORDING APPARATUS HAVING RELEASABLE FIXING DEVICE

[75] Inventors: Masatoshi Takano, Tokyo; Kazuhiro Ichinokawa, Kawagoe; Satoshi Hokamura, Niza, all of Japan

[73] Assignee: Asahi Kogaku Kogyo Kabushiki Kaisha, Tokyo, Japan

[21] Appl. No.: 422,507

[22] Filed: Oct. 17, 1989

[30] Foreign Application Priority Data

| | | | |
|---|---|---|---|
| Oct. 17, 1988 | [JP] | Japan | 63-135258[U] |
| Oct. 28, 1988 | [JP] | Japan | 63-141416[U] |
| Oct. 28, 1988 | [JP] | Japan | 63-141418[U] |

[51] Int. Cl.[5] ..... G03G 15/20

[52] U.S. Cl. ..... 355/200; 355/282

[58] Field of Search ..... 355/282, 285, 200; 219/216

[56] References Cited

U.S. PATENT DOCUMENTS

| | | | |
|---|---|---|---|
| 4,145,181 | 3/1979 | Edwards et al. | 355/282 X |
| 4,401,385 | 8/1983 | Katayama et al. | 355/299 |
| 4,555,173 | 11/1985 | Iseki et al. | 355/200 |
| 4,589,758 | 5/1986 | Kasama et al. | 355/295 |
| 4,641,947 | 2/1987 | Ishida et al. | 355/200 |
| 4,642,661 | 2/1987 | Dean, II | 346/153.1 |
| 4,754,293 | 6/1988 | Aizawa et al. | 346/160 |
| 4,760,424 | 6/1988 | Ohba et al. | 355/245 |
| 4,806,970 | 2/1989 | Nakatomi et al. | 355/282 |
| 4,879,580 | 11/1989 | Kaneda | 355/282 X |
| 4,941,002 | 7/1990 | Maruyama et al. | 346/160 |

FOREIGN PATENT DOCUMENTS

| | | | |
|---|---|---|---|
| 0160971 | 9/1983 | Japan | 355/282 |
| 0104959 | 6/1985 | Japan | 355/200 |
| 0299982 | 12/1987 | Japan | 355/282 |
| 63-15264 | 1/1988 | Japan . | |
| 0082494 | 4/1988 | Japan | 355/282 |
| 0013180 | 1/1989 | Japan | 355/282 |
| 0015784 | 1/1989 | Japan | 355/282 |
| 0167853 | 7/1989 | Japan . | |

*Primary Examiner*—A. T. Grimley
*Assistant Examiner*—Nestor R. Ramirez
*Attorney, Agent, or Firm*—Sandler, Greenblum & Bernstein

[57] ABSTRACT

An image recording apparatus employing a fixing unit for fixing a toner image on a recording sheet by pressing and, or heating by means of a pair of fixing rollers disposed opposite to each other. At least one of the fixing rollers is arranged to be releasable manually or automatically when a clamshell is opened.

3 Claims, 15 Drawing Sheets

IMAGE RECORDING APPARATUS HAVING RELEASABLE FIXING DEVICE

BACKGROUND OF THE INVENTION

The present invention relates to an image recording apparatus employing a fixing unit having a pair of fixing rollers.

Conventionally, an image recording device is known which utilizes an electrophotographic system in which a surface of a photoconductive drum is exposed to light to form a latent image on the drum surface. Toner is then applied to the latent image to develop the image, and the developed image is transferred onto a recording sheet and is fixed at a fixing station. Such an image recording device is chiefly employed in copying machine. In recent years, however, the image recording device has been utilized in a printer or the like, for printing out output from a computer, one of which is a laser beam printer.

The laser beam printer comprises, for example as illustrated in FIG. 1, a photoconductive drum 1. Arranged about the photoconductive drum 1 in order of the rotational direction thereof are a charging station A, an exposure station B, a developing station C, a transferring station D, a toner-cleaning station E, and a discharge station F.

The arrangement is such that at the exposure station B, the laser beam scans the surface of the drum 1 which has been uniformly charged at the charging station A, to thereby form a latent image on the charged drum surface. Toner is then applied at the developing station C to the latent image to develop the same. Subsequently, the developed toner image is transferred at the transferring station O onto the recording sheet P which is fed at a velocity identical with the circumferential speed of the photoconductive drum 1.

The recording sheet P carrying the toner image transferred thereon at the transferring station D is guided and/or fed by guide rollers to a fixing station G. The recording sheet P is then heated and/or pressed at the fixing station G in order for the toner image to be fixed onto the surface of the recording sheet P.

As for the fixing station G, various types have hereto fore been known in this field and a fixing station of the heat roller type capable of high-speed operation with high thermal efficiency is generally used The heat roller type comprises a heat roller whose surface is heated by a heat source such as a halogen lamp up to approximately 160° C.-200° C. and a press roller (backup roller) coated with heat resistant elastic material. Both rollers are disposed face to face. While the press roller is used to press the heat roller under predetermined pressure a, recording sheet carrying an unfixed toner image is passed therethrough, whereby the toner image is fixed onto the recording sheet as the toner is fused by the heat applied from the heat roller.

However, the disadvantage of the conventional fixing station is that, since the heat and press rollers are forced to abut each other under the predetermined pressure, the recording sheet cannot readily be removed during maintenance interruption while the recording sheet is fed to the fixing station, i.e. in between both the rollers.

SUMMARY OF THE INVENTION

It is therefore an object of the invention to provide an improved image recording apparatus employing a fixing unit having a pair of fixing rollers, at least one of which is manually or automatically releasable from pressure contact with the other.

In order to accomplish the object according to the present invention, an imaging apparatus utilizes an electrophotographic system to form a toner image on a recording medium, which comprise a pair of fixing rollers for fixing the toner image onto the recording medium, the rollers being forced to contact each other under pressure, and release means for releasing at least one of the pair of fixing rollers away from the other one.

DESCRIPTION OF THE ACCOMPANYING DRAWINGS

DESCRIPTION OF THE EMBODIMENTS

Figure 1:
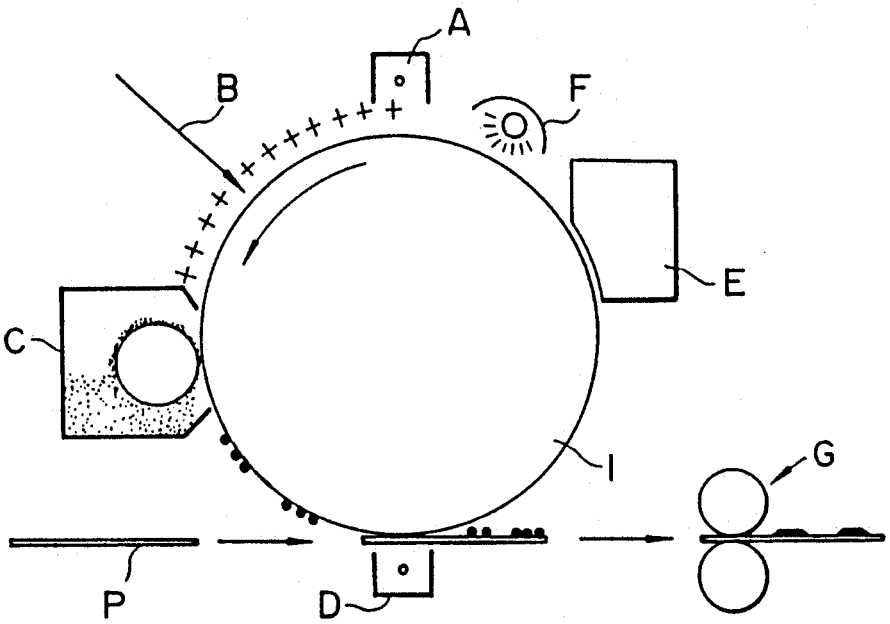
FIG. 1 PRIOR ART
FIG. 1 is a schematic side view of a conventional image recording apparatus according to the electrophotographic system.
Figure 2:
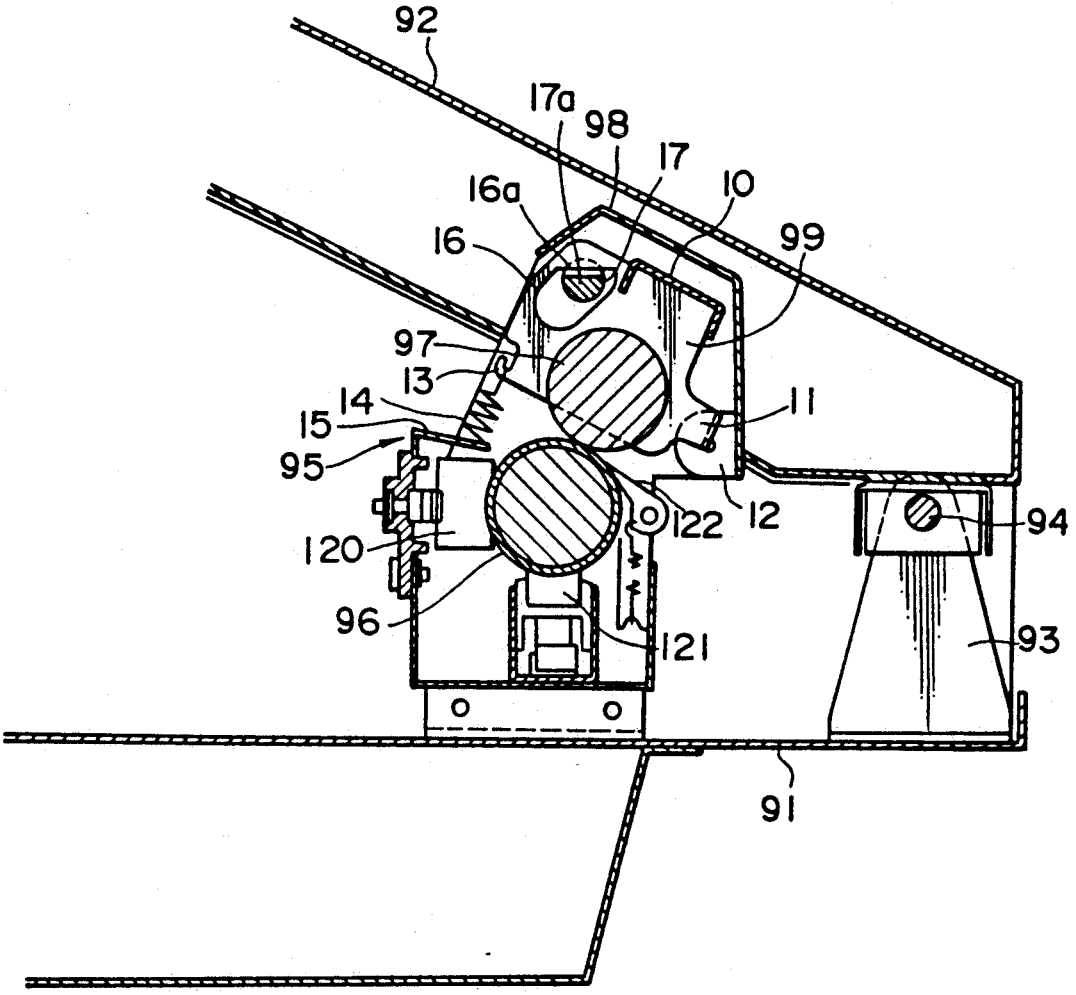
FIG. 2 is a schematic sectional view of a fixing unit of a laser beam printer according to a first embodiment of the present invention.

FIG. 2 is a schematic sectional view of a first embodiment of the present invention. As shown in FIG. 2, the first embodiment comprises a base 91 of the body of an imaging apparatus such as an electronic copying machine, a clamshell 92 covering the upper portion of the body, the clamshell being pivotally fitted to a bracket 93 secured to the base 91 by means of a pin 94 so as to make it openable.

This embodiment further comprises a fixing unit 95 of the imaging apparatus, a transfer unit (not shown) upstream (on the left-hand side of FIG. 2) thereof and a paper discharge chute (not shown) downstream (on the right-hand side of FIG. 2) thereof.

The fixing unit 95 consists of a heat roller 96 and press roller 97, these rollers together with their peripheral equipment being incorporated in an unit box 98.

Rubber material having a predetermined hardness is wound on the surface of the press roller 97, which is pivotally supported between a pair of support plates 99 disposed on both lateral sides. As shown in FIG. 2, these support plates 99 have their upper ends integrally coupled by a frame 10. Projections 11 are formed at the respective rear ends of the support plates 99 and pivotally fit to the bracket 12 formed in the unit box 98. Hooks 13 are also formed at the respective front ends of the support plates 99, whereas tension springs 14 are stretched between the hooks 13 and catches 15 formed in the front portion of the unit box 98, respectively. As a result, the press roller 97 is forced into contact with the heat roller 96 under predetermined pressure because of the tensile force of the tension springs 14.

U-shaped openings 16 are formed at the respective upper ends of the support plates 99 and a shaft 17 passes through the openings 16 (FIG. 2).

Figure 3:
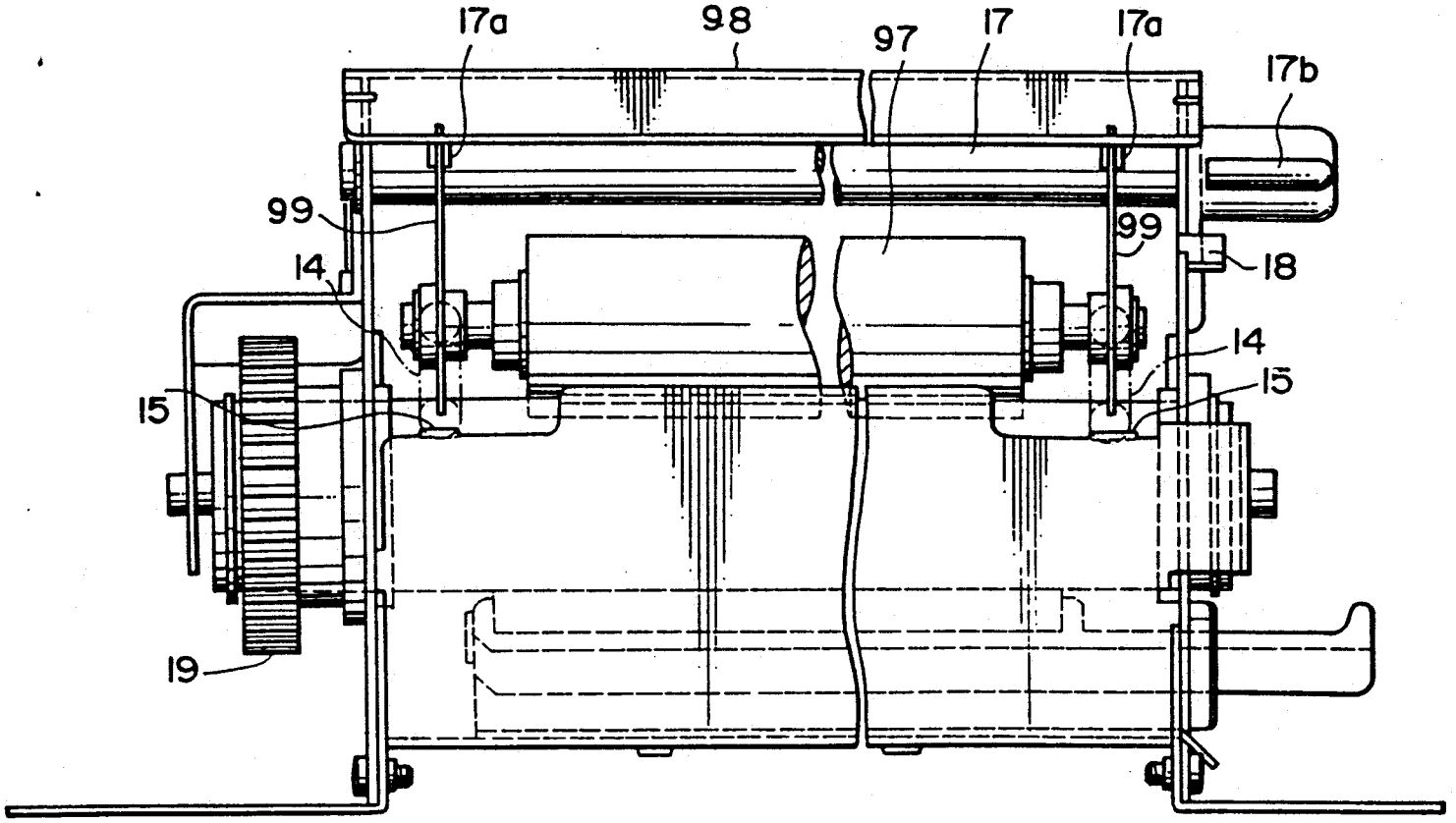
FIG. 3 is an elevational view of the fixing unit of the first embodiment.
Figure 4:
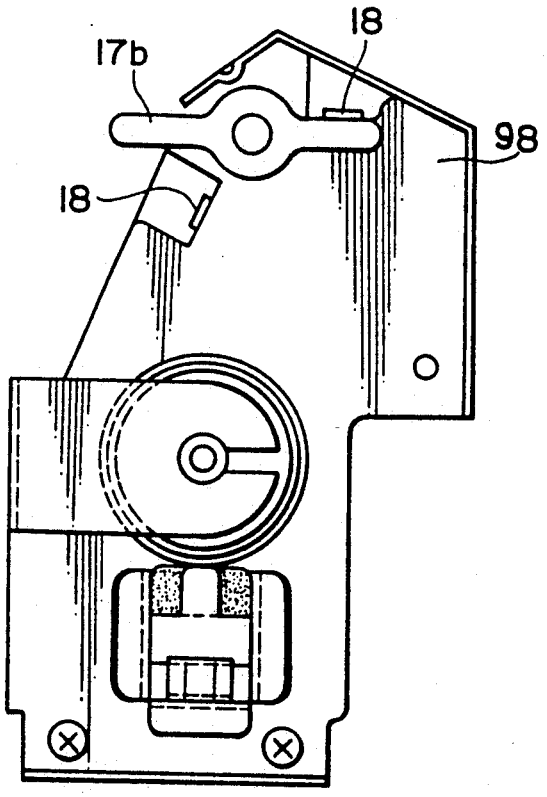
FIG. 4 is a right-hand side view of FIG. 3.

Both ends of this shaft 17 are pivotally supported with the unit box 98 and a lever **17*b* is formed at one end thereof as shown in FIG. 3. The lever 17*b* is rotatable within the range of stoppers 18 which are provided on the respective side faces of the unit box 98**.

Figure 5:
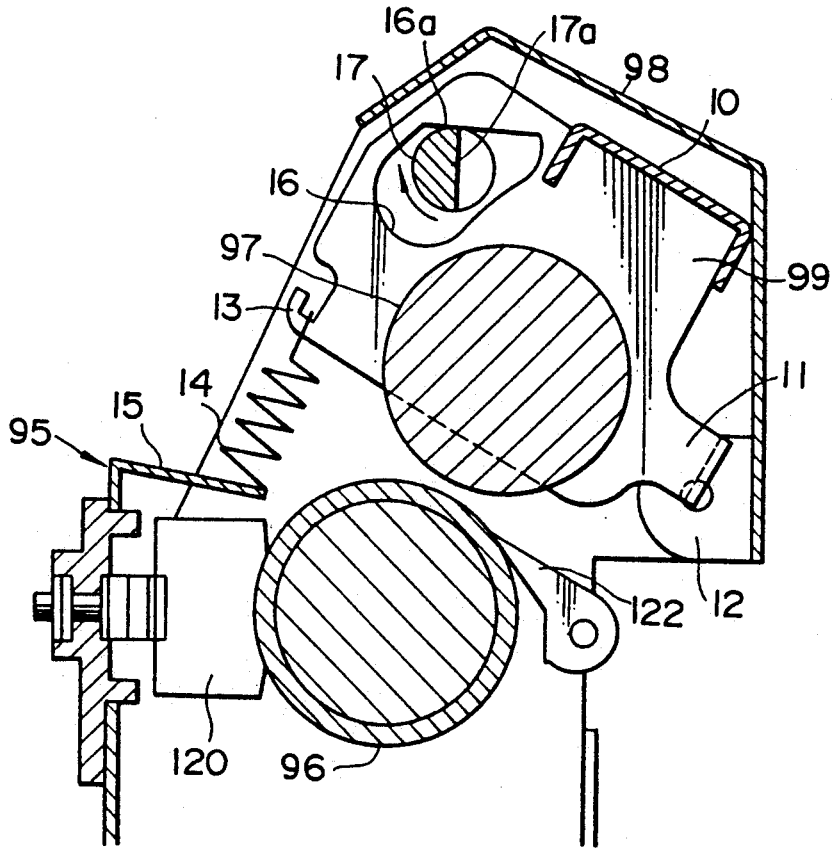
FIG. 5 is a diagram illustrating the operation of the fixing unit of the first embodiment.

Notches **17*a* are formed in the intermediate portion of the shaft 17 and the openings 16, 16 are mated with the respective notches 17*a*. Linear portions 16*a*, 16*a* are formed in the respective openings 16, 16 and, as shown in FIG. 5, the notches 17*a* interfere with the respective linear portions 16*a* as the shaft 17 rotates to raise the support plates 99 against the tensile force of the springs 14**.

The heat roller 96 is coated with resin for preventing toner offsetting and promoting the peeling of recording paper. The surface of the heat roller 96 is adequately heated by a heating means such as a halogen lamp located inside the roller. The heat roller 96 is rotated by a motor (not shown) and (a torque transmission gear 19 as shown in FIG. 3). The press roller 97 is rotated together with the rotation of the heat roller 96.

In FIG. 2, there is further shown an arrangement of a thermostat 120 for preventing an abnormal rise in temperature, a heat roller cleaner 121 and a scraper 122 for scraping recording paper adhering to the roller 96.

A description will now be given of the operation of the embodiment shown.

The recording paper having the toner electrostatically transferred thereto by the transfer unit is fed in between the press roller 97 and the heat roller 96 to apply pressure and heat to the toner, whereby it is fused to the recording paper. In case the recording paper is jammed between the rollers for some reason at this time, the lever **17*b* is turned first and the shaft 17 is turned by a predetermined angle (e.g. 90°). Then each of the notches 17*a*, interfere with the linear portions 16*a*, 16*a* of the support plate openings 16, so that the support plates 99, are raised against the tensile force of the tension springs 14. Consequently, the press roller 97 is separated from the heat roller 96**. The recording paper is removed in this state.

After the recording paper has been removed, the lever **17*b* is slowly lowered so that the support plates move down because of the tensile force of the tension springs 14. The press roller 97** is thus returned to the original position where it is pressed down.

Figure 6:
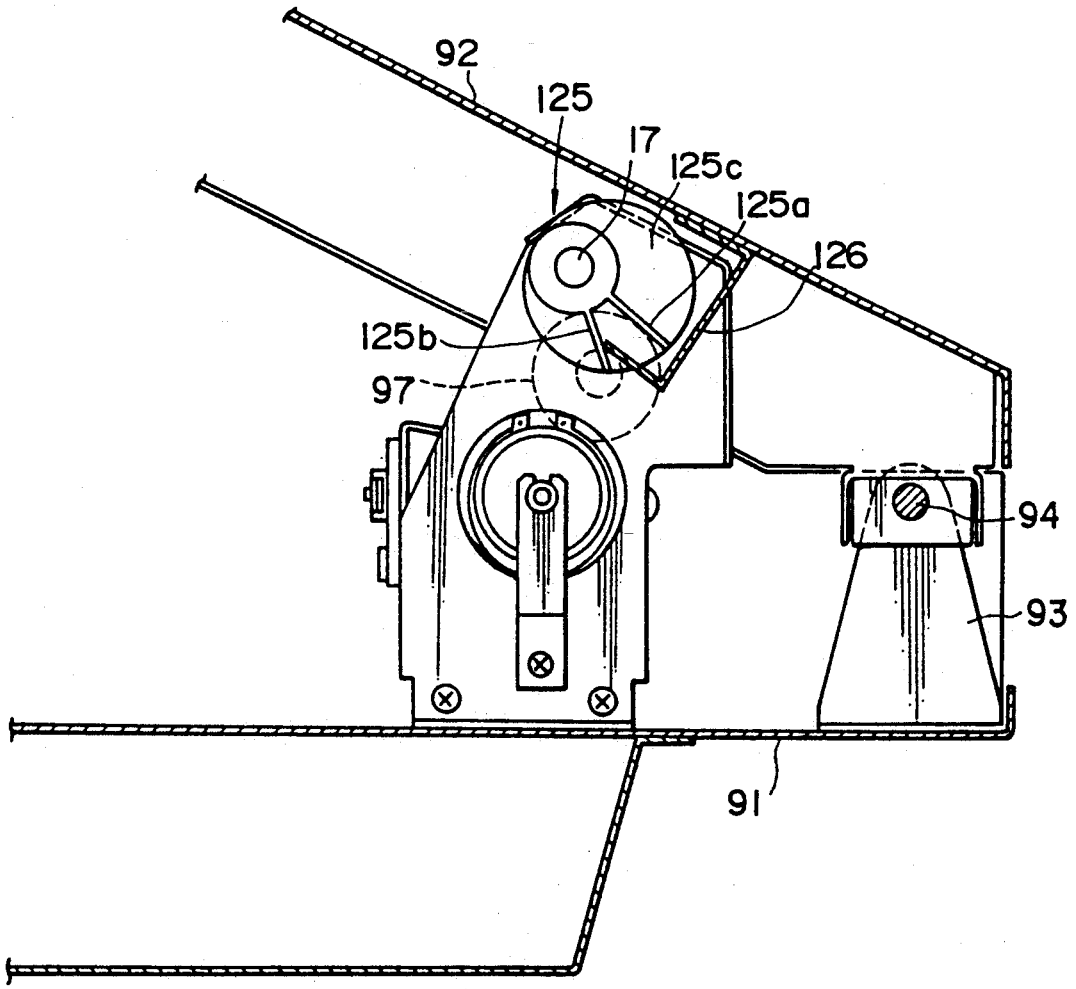
FIG. 6 is a schematic view of a fixing unit of a second embodiment of the present invention.
Figure 7:
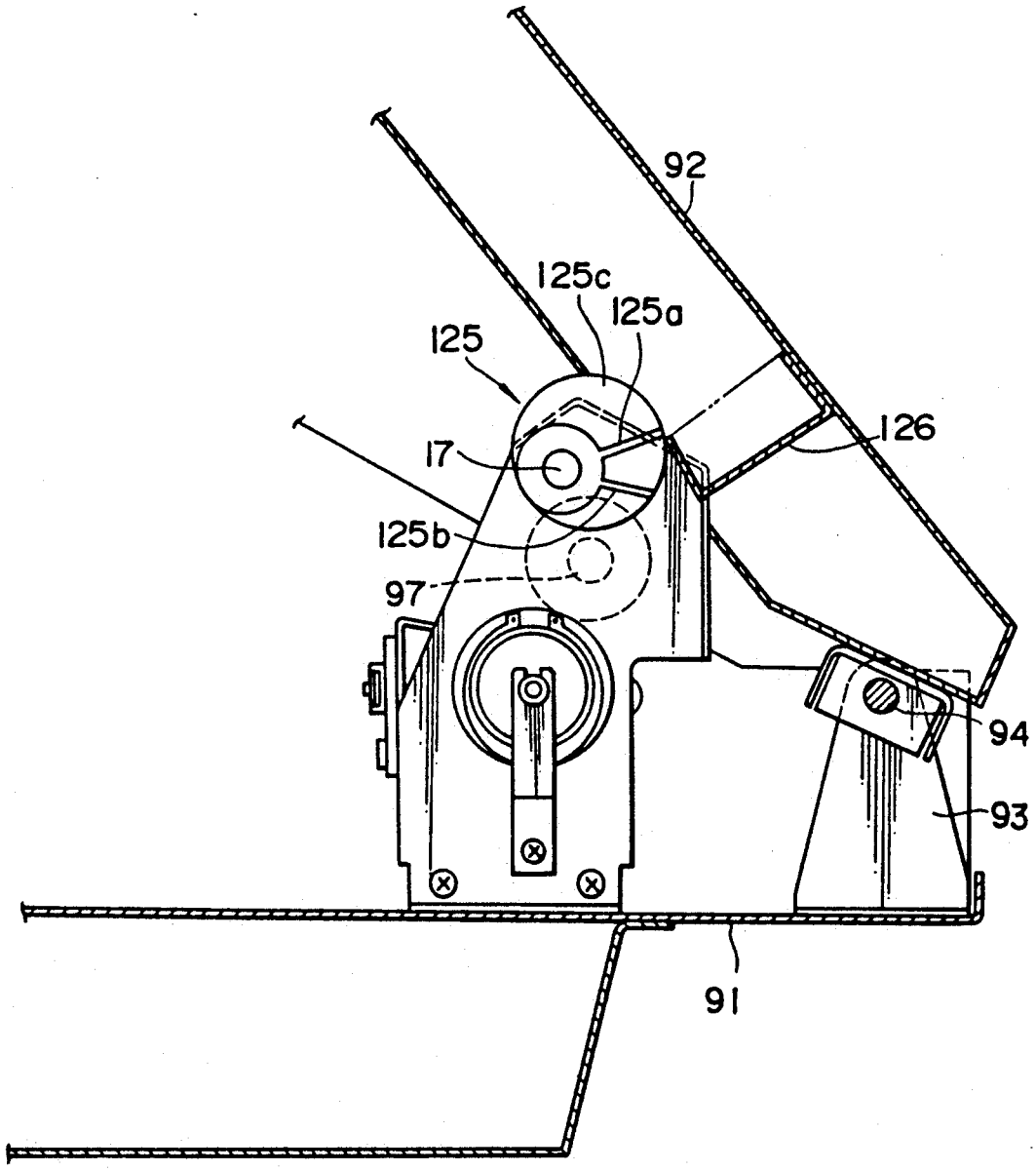
FIG. 7 is a schematic diagram illustrating the operation of the fixing unit of the second embodiment.

FIG. 6 shows another embodiment of the present invention, wherein the pivoting operation of the clamshell 92 is interlocked with the vertical movement of the press roller 97.

More specifically, a cam 125 is secured to one end of the shaft 17, whereas a hook 126 is secured to the clamshell opposite to the cam 125.

Mating pawls **125*a*, 125*b* inclined by a predetermined angle are formed on the cam 125 and integrally secured to a back disc 125*c*. Moreover, the mating pawls 125*a*, 125*b* are arranged so that the upper pawl 125*a* is longer than the lower pawls 125*b*, the front end of the hook 126 of the clamshell 92 being located between these mating pawls 125*a*, 125*b***.

In this embodiment shown, the hook 126 is caught by the mating pawls **125*a* of the cam 125 when the clamshell 96 is opened as shown in FIG. 6, whereby the cam 125 is rotated counterclockwise by a predetermined angle. As a result, the shaft 17 is also rotated and the notches, 17*a* interfere with the support plate openings, 16 to raise the press roller 97. Notches 17A and plate openings 16 are illustrated in FIG. 5. When the clamshell 92 is closed by a predetermined angle, the cam is caused to rotate clockwise as the mating pawl 125*b* is forced down by the hook 126. When the clamshell 92 is completely closed, the notches, 17*a* are released from the interference of the openings, 16 and the support plates, 99 are forced down by the tensile force of the springs 14, whereby the cam 125 is locked while the mating pawl 125*b* remains pressed by the hook 126**.

Although the aforementioned embodiment refers to a case where the press roller 97 is vertically displaced, the heat roller 96 may be vertically displaced when the press roller 97 and the heat roller 96 are disposed in reversed positions.

As set forth above, since at least one of the heat roller and the press roller is vertically displaceable according to the first and second embodiments, the rollers can be released from clinging to each other by forcing up the displaceable roller when the recording paper is mis-fed in the fixing unit. The recording paper jammed in between both the rollers is easily removed thus making maintenance simple.

Figure 8:
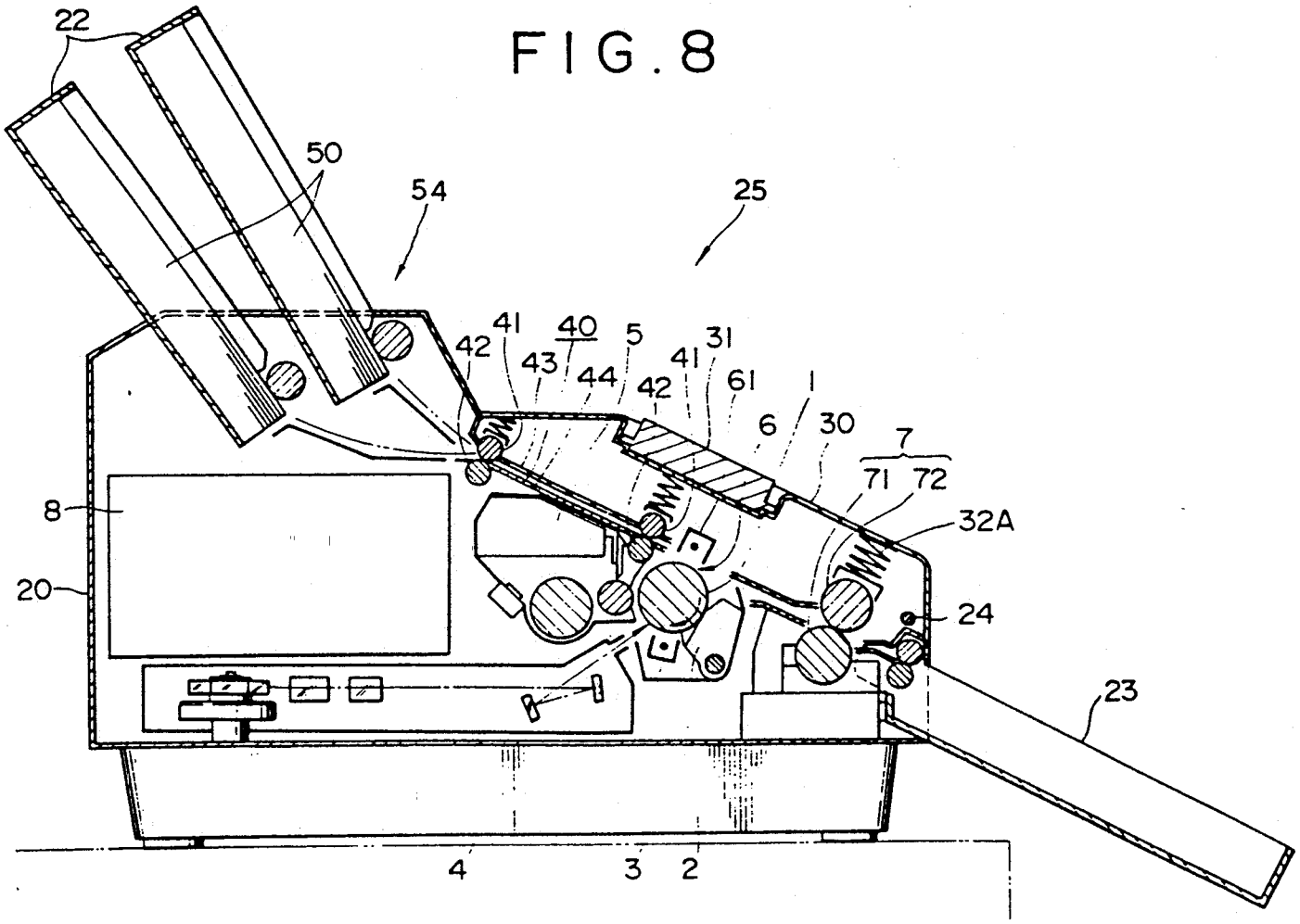
FIG. 8 is a schematic side view illustrating a laser beam printer having the fixing unit according to a third embodiment of the invention.

FIG. 8 is a schematic side view of a laser beam printer as an electrophotographic printer embodying the present invention, this printer being a so-called page printer in which cut-sheets cut into predetermined sizes are used.

The laser beam printer 25 shown in FIG. 8 looks like a rectangular parallelepiped with its top diagonally cut at a predetermined angle. The uppermost section of a body 20 forms a cassette holding paper holder portion 54 to receive a pair of paper cassettes 22 in which the papers which differ in size are respectively stored.

While printing is being executed, the recording papers are sequentially introduced one by one into a paper feed path 40.

A discharge paper tray 23 is provided at the side of the body 20 opposite in the diagonal direction to the cassette holding portion 54.

The discharge paper tray 23 is capable of rocking vertically at a predetermined angle and also of being fixed still at any given angle.

Figure 9:
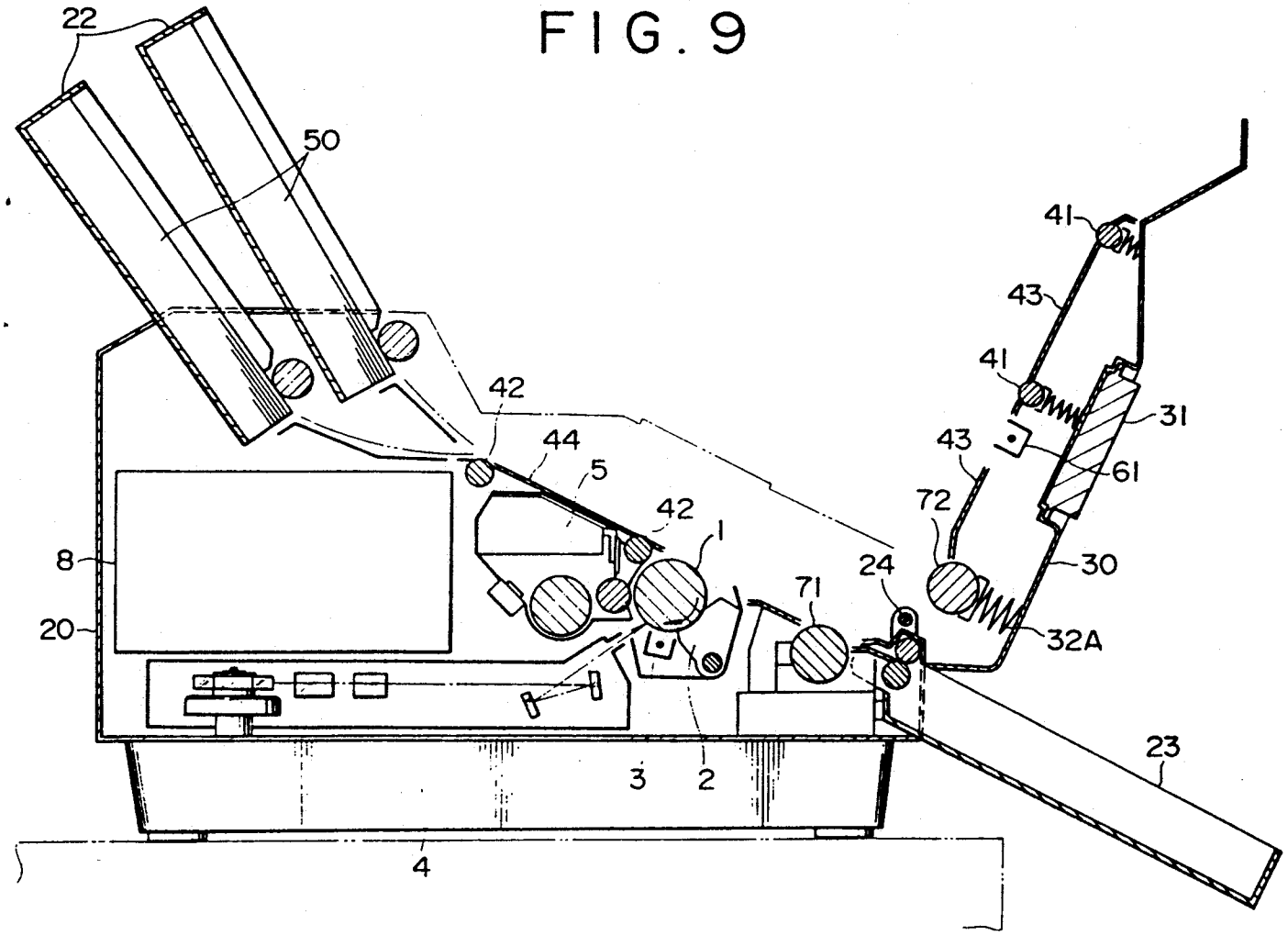
FIG. 9 illustrates the upper component member of the third embodiment in the opened position.

The clamshell 30 forms an inclined surface portion of the printer 25 and its upper end portion is rockably coupled to the body 20 by means of a pivot shaft 24 in a manner capable of rocking. The lower end portion of the clamshell 30 is allowed to rock away from the body 20 with the shaft 24 as a fulcrum so that the clamshell 30 is able to open as shown in FIG. 9. A control panel 31 for operating the printer 25 is mounted on the inclined surface of the clamshell 30.

Cover plates 43, 44, which are provided in a position where the clamshell 30 is directed opposite to the body 20, are used to form the recording sheet feed path 40, having a predetermined space when the clamshell 30 is closed with respect to the body 20. The clamshell 30 is substantially uniform in thickness and the recording sheet feed path 40 is directed downward with substantially the same angle as that of the surface of the clamshell 30.

A pair of opposed feed rollers 41, 42 are respectively provided on the cover plates 43, 44, one of the feed rollers 41, 42 being driven to rotate by a drive means, not shown.

A photoconductive drum 1 is disposed opposite to a paper feed path 40 under the substantially central area of the paper feed path 40 in the body 20.

Around the photoconductive drum 1 in the body 20, the following units are disposed in the direction of rotation, in the order described below: a cleaning unit 2 for removing toner remaining on the surface of the drum 1, a charging unit 3 for uniformly charging the surface of the drum 1, a laser scanning unit 4 for scanning the charged surface of the drum 1 with laser beams carrying image data to form a latent image thereon, and a developing unit 5 for putting toner onto the portion of the surface of the drum 1 which is exposed to the laser beams to develop a toner image. Reference numeral 8 represents a control unit for controlling the operation of the printer 25 including a power source.

On the other hand, a corona charger 61 for charging the recording paper 50 so that the toner image on the drum 1 is transferred thereto is disposed opposedly to the drum 1 with the paper feed path 40 therebetween. The corona charger 61 and the portion of the drum 1 opposed thereto constitute a transfer unit 6.

A fixing unit 7 is arranged downstream of the transfer unit 6 along the paper feed path 40. The fixing unit 7 comprises heat roller 71 and an opposedly disposed a backup roller 72 for defining the paper feed path 40 therebetween. The recording paper 50 carrying the unfixed toner image is nipped between the rollers 71, 72 and the toner is fixed onto the recording paper 50 by heat and pressure applied by the heat roller 71. A drive motor, not shown, is employed to rotate the heat roller 71 to feed the recording paper 50 in the fixing unit 7.

The laser beam printer thus constructed operates as follows:

The recording paper 50 stored in one of the paper cassettes 22 fitted to the cassette holding portion 54 of the body 20, is drawn out of the cassette 22 one by one. The recording paper thus introduced into the paper feed path 40, is fed by the feed rollers 41,42. The toner image formed on the surface of the photoconductive drum 1 is transferred to the undersurface of the recording paper 50 at the transfer unit 6. The toner image transferred onto the undersurface of the recording paper 50 is fixed by the fixing unit 7, and the recording paper 50 is then discharged onto the paper tray 23 with its image-carrying side down (i.e. in facedown state).

The holders 21 are projected upwardly from the respective portions where the heat roller 71 is held and slits 21A into which the shaft of the backup roller 72 is fitted are formed in the respective projected portions.

The backup roller 72 is held with a bracket 32 secured to the clamshell 30 and a spring 32A is used to bias and press the backup roller toward the recording paper feed path 40 (i.e. the heat roller 71).

In the fixing unit 7 thus constructed, the shaft of the backup roller 72 is fitted into the slits 21A of the holder 21 while the clamshell 30 is closed with respect to the body 20. The backup roller 72 is biased and pressed by the spring 32A against the heat roller 71 in the predetermined direction under predetermined pressure. The fixing operation is thus ready to start. More specifically, the backup roller 72 is pressed against the heat roller 71 under the predetermined pressure and the recording paper 50 carrying unfixed toner is nipped between both rolls. The toner is then fixed onto the recording paper 50 by heating and pressing the recording paper with the heat roller 71 and the recording paper 50 with the fixed toner is driven to be conveyed by the heat roller 71 before being discharged onto the tray.

Figure 10:
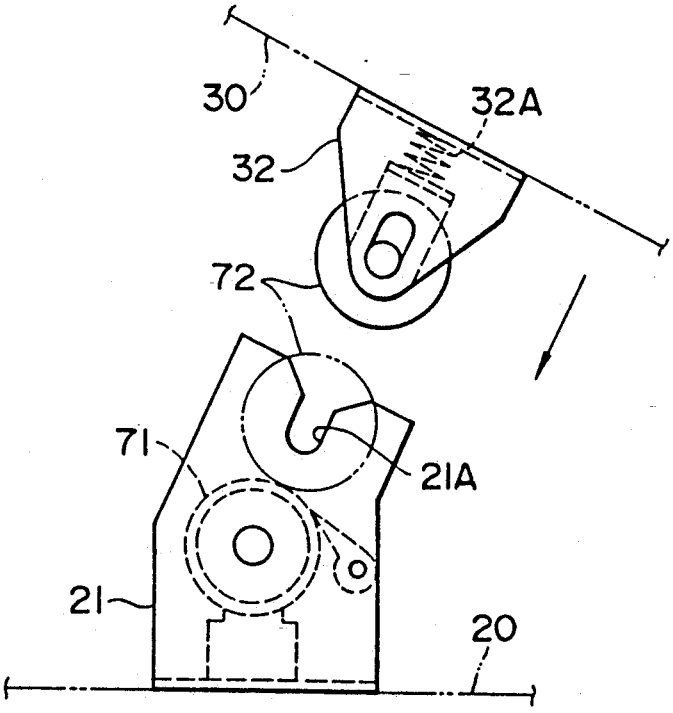
FIG. 10 is an enlarged view of the fixing unit of the third embodiment.

When the clamshell 30 is opened, the backup roller 72 is separated from the heat roller 71 as the clamshell 30 rocks as shown in FIGS. 9 and 10. The recording paper jammed in between the backup roller 72 and the heat roller 72 can readily be removed only by opening the clamshell 30 during maintenance resulting from paper-jamming.

Figure 11:
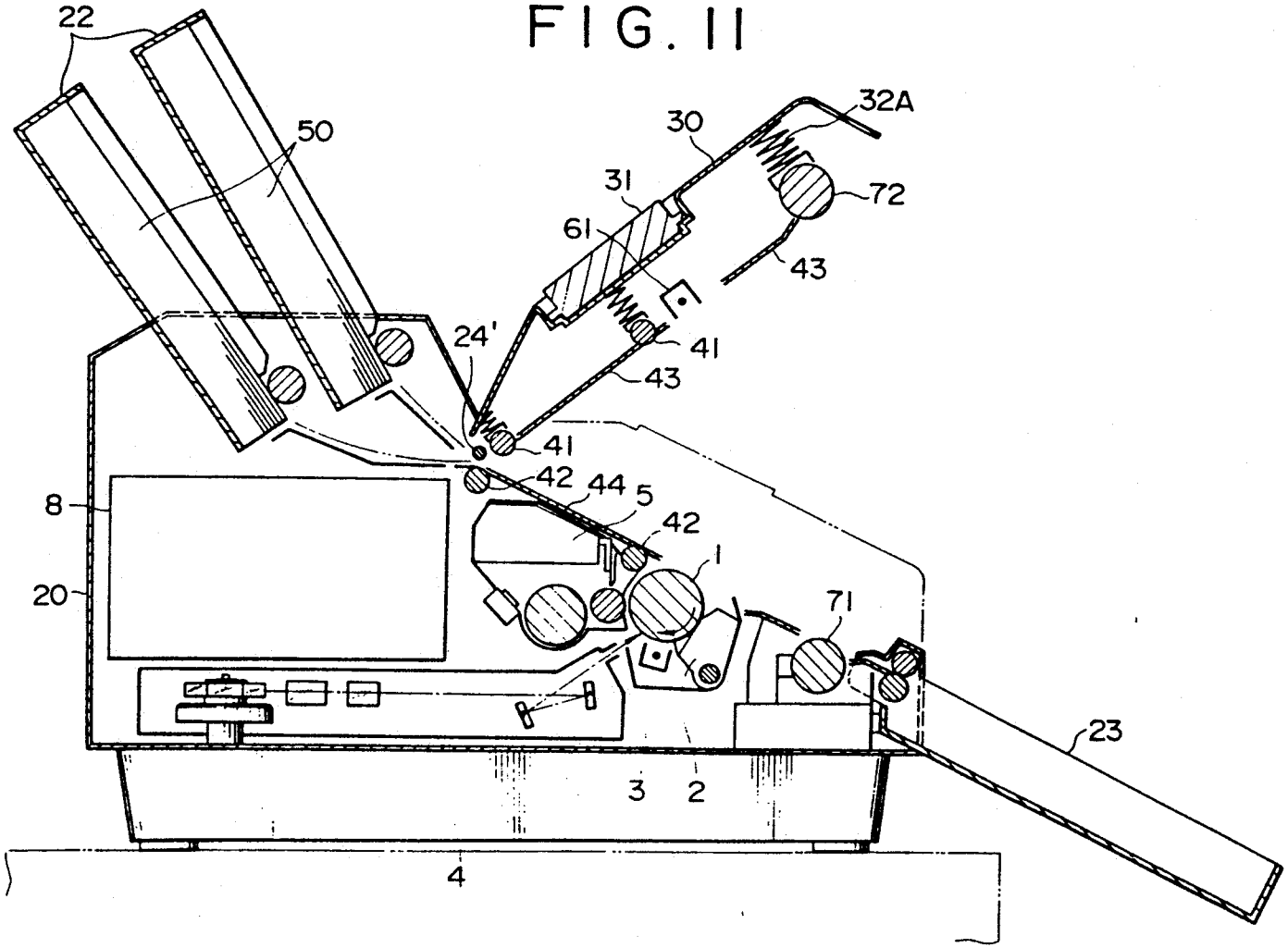
FIG. 11 is a side view of the upper component member of the third embodiment wherein the opening direction thereof is different than as shown in FIG. 9

In this embodiment, the clamshell 30 has been arranged so that it is opened with its lower end rotatably coupled to the body 20 and with its upper end capable of rocking in a direction in which it is allowed to move away from the body 20. However, the clamshell 30 may be reversely arranged, as shown in FIG. 11, where it is opened with its upper end rotatably coupled to a shaft shown by 24' and its lower end capable of rocking in a direction in which it is allowed to move away from the body 20.

As set in this third embodiment, the rollers of the fixing unit are separated when the upper component member is opened whereby maintenance resulting from paper-jamming, i.e. the recording paper being jammed in the fixing device, can be effected readily and simply.

Figure 12:
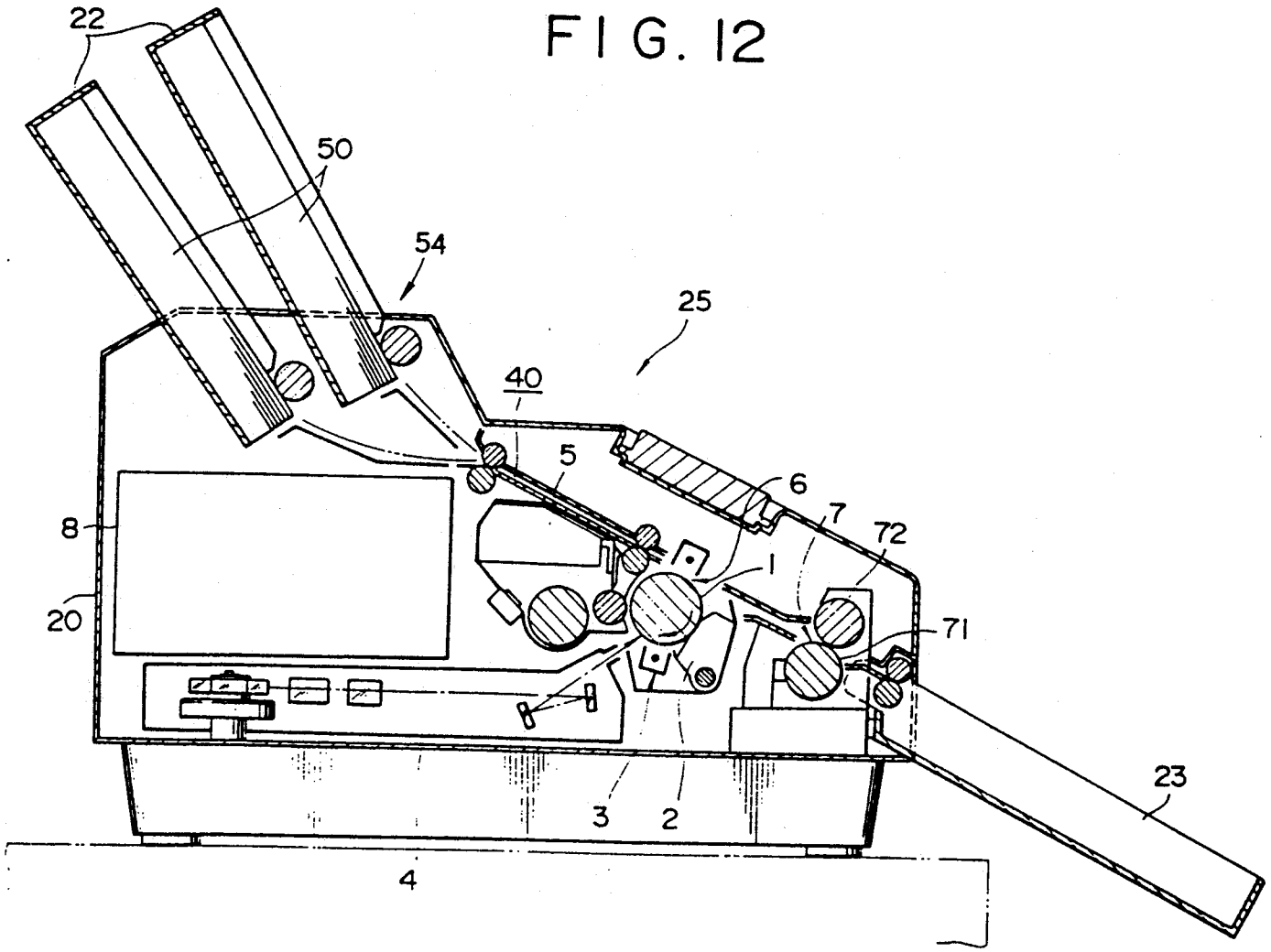
FIG. 12 is a schematic side view illustrating a laser beam printer having the fixing unit of a fourth embodiment.

FIG. 12 is a schematic side view of a roller release mechanism in a fixing unit of a laser beam printer as a fourth embodiment of the present invention. As the basic construction is substantially similar to what is shown in FIG. 8, a detailed description thereof will be omitted.

Figure 13A:
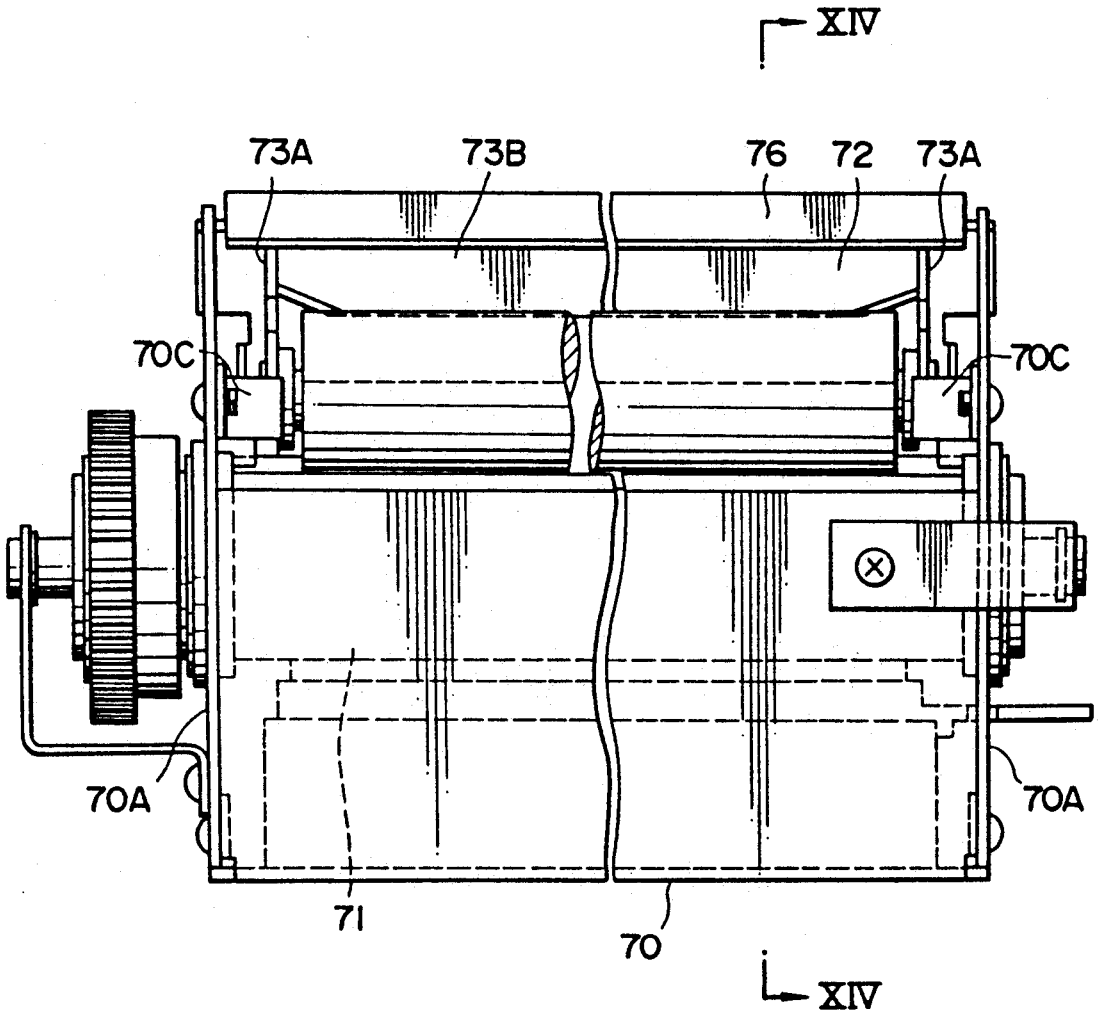
FIG. 13A is a top view of the fixing unit.
Figure 13B:
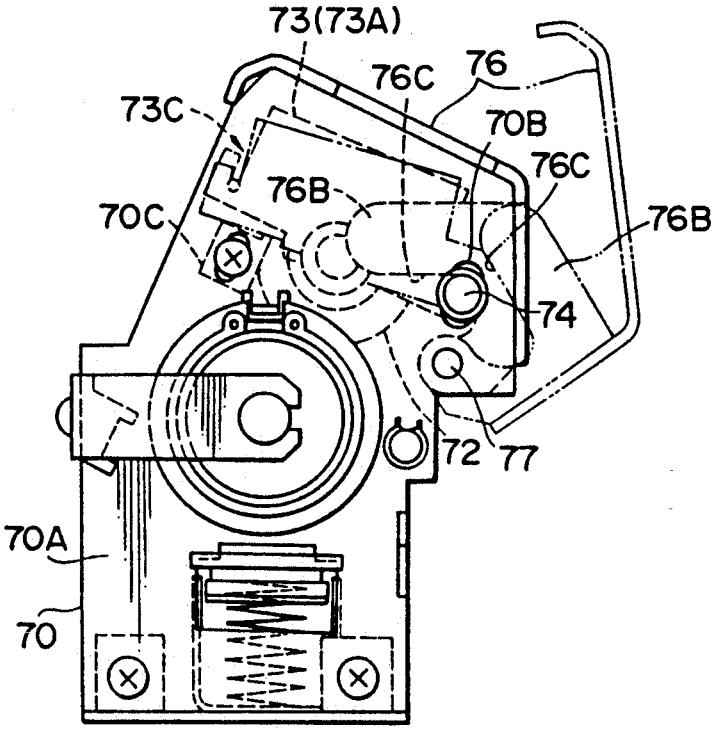
FIG. 13B is a side view thereof.
Figure 14:
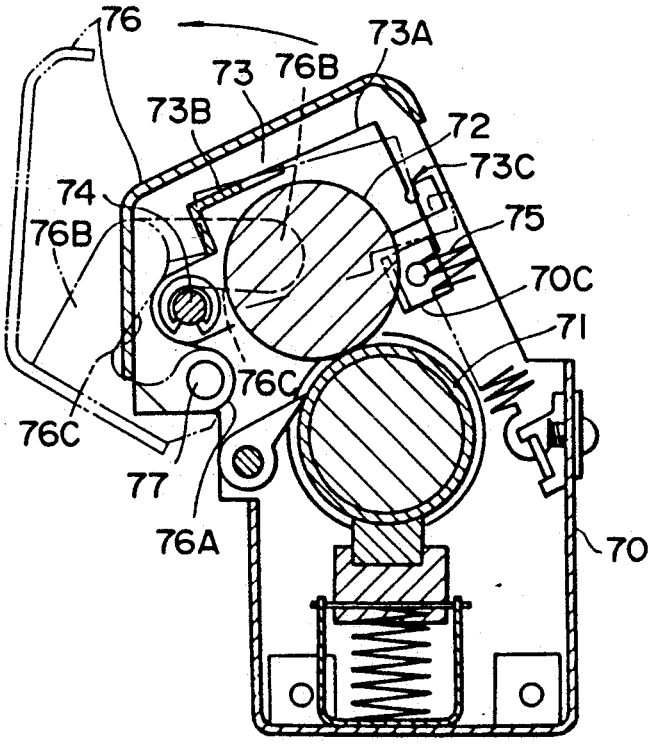
FIG. 14 is a sectional view taken on line XIV—XIV of FIG. 13A.

In the fourth embodiment, the fixing unit 7 whose elevational and side views are shown in FIGS. 13A, 13B and whose sectional view taken on line XIV—XIV of FIG. 13A is shown in FIG. 14 comprises the heat roller 71 and the backup roller 72 vertically disposed opposite to each other with the recording paper feed path 40 therebetween.

The heat roller 71 is rotatably held in a frame 70 of the fixing unit and disposed under the recording paper feed path, the frame 70 being provided perpendicularly to a chassis (not shown) for the printer as a whole. The heat roller 71 is coated with resin for preventing toner offsetting and promoting the peeling of recording paper. The surface of the heat roller 71 is adequately heated by a heating means such as a halogen lamp located inside the roller. The heat roller 71 is rotated by a drive means (not shown) at a circumferential speed synchronized with that of the photoconductive drum 1 and is used to fix toner onto the recording paper 20 which is nipped between the heat and backup rollers 71, 72 and simultaneously to drive the recording paper 50 to be discharged.

The backup roller 72 is disposed above the heat roller 71 and is supported by a support arm 73 as a support member.

The support arm 73 is a metal fitting which is a substantially inverted U-shaped with both side plates 73A coupled with a top plate 73B. The shaft portions at both ends of the backup roller 72 are rotatably mated with the centers of the respective side plates 73A to fix the backup roller.

The paper discharge side ends of the side plates 73A of the support arm 73 are pivotally supported on side plates 70A of frames 70 by means of shafts 74. The support arm 73 is fitted so that it is capable of rocking about the shafts 74. As the support arm 73 rocks about the shafts 74, the backup roller 72 is allowed to contact and move away from the heat roller 71.

the side plate 70A of each frame 70 mating with the shaft 74 is formed with a vertical slit 70B and the shaft 74 is allowed to slide along the slit 70B. In other words, the support arm 73 rocks about the shafts 74, whereas the shafts 74 formig rocking centers are also movable along the respective slits 70B vertically to a predetermined extent.

Hooks 73C which are upwardly opened are formed at the recording paper guide side ends of the side plate 73A of the support arm 73 and the upper ends o coil springs 75 are engaged with the respective hooks 73C.

The lower end of each coil spring 75 is engaged with the frame 70 of the fixing unit 7 and the resetting force is used to bias the recording paper guide end side (i.e. the side end portion of the hook 73C) of the support arm 73 to force it downward. As a result, the support arm 73 is biased to rock about the shafts 74 in the downward direction and the backup roller 72 which is fitted to the support arm 73 is biased to be pressed against the heat roller. Further, stoppers 70C which abut against the underside of the hooks 73C of the side plates 73A of the support arm 73 and are used to regulate the rocking range of the support arm 73 are secured to predetermined positions of the inner sides of the side plates 70A of the respective frames 70.

An openable roller cover 76 capable of rocking is pivotally fitted to each frame 70. The roller cover 76 functions as a pressure regulating member and simultaneously as a cover for covering the upper side of the backup roller 72.

The roller cover 76 is fitted by pivotally fitting tongue-like fitting projections 76A bent perpendicularly from both ends of the cover portion to the vicinity of the mating portion of the shaft 74. Tongue-like cam projections 76B similar to the fitting projections 76A projected substantially parallel to the fitting projections 76A above the fitting projections 76A. When the roller cover 76 is closed, the downsides 76C of the cam projections 76B abut against and force down the upper side of the shaft 74.

In the fixing unit 7 thus constructed, the support arm 73 is drawn by the coil springs 75 in a direction in which the hooks 73C are located thereunder as shown by imaginary lines of FIGS. 13B and 14 while the roller cover 76 is kept open and the downside of the support arm 73 is allowed to rock until it abuts against the stoppers 70C. The rocking fulcrum of the support arm 73 at this time is the contact between the backup roller 72 and the heat roller 71.

After the downside of the support arm 73 abuts against the stoppers 70C, the tensile force of the coil springs 75 acts in such a manner as to make the support arm 73 rock with the position where it abuts against the stoppers 70C as a fulcrum (i.e. to lift the shaft 74). The support arm 73 stops when total weight of the backup roller 72 and the support arm 73 is balanced with the tensile force of the coil spring 75 or when the sliding movement of the shaft 74 is restricted with the upper ends of the slits 70B. In other words, the backup roller 72 is caused to be separated from the heat roller 71 or stopped while it is not biased nor pressed. In this state, the recording paper jammed in between both the rollers 71, 72 can easily be removed. The position of the backup roller 72 when the roller cover 76 is opened or the pressure applied to the heat roller 71 can be set optionally by properly setting the position of the stoppers 70C, the weight of the backup roller 72, the tensile force of the coil springs 75 and the longitudinal length of the slits 70B.

When the roller cover 76 is closed after it is opened, the downsides 76C of the cam projections 76B of the roller cover 76 abut against the shaft 74 and force down the shaft 74 along the slits 70B. The outer periphery of the backup roller 72 is forced to contact the outer periphery of the heat roller 71 at this time and the support arm 73 is caused to rock with the shaft 74 as its underside and the position of the contact between both the rollers as a fulcrum. As a result, the hooks 73C of the support arm 73 are separated from the stoppers 70C and caused to rock upwardly against the tensile force of the coil springs 75. In other words, the support arm 73 is caused to rock with the hooks 73C as its underside and the shaft 74 restricted by the cam projections 76B of the roller cover 76 as a fulcrum because of the tensile force of the coil springs 75. The backup roller 72 is forced to contact the heat roller 71 under such pressure as to make the fixing operation possible (the state indicated by a continuous line of FIGS. 13B and 14).

The downsides 76C of the cam projections 76B of the roller cover 76 become substantially horizontal and the counter force derived from the operation of forcing the backup roller 72 to contact the heat roller 71 on the downsides of the cam projections 76B acts to bias the shaft 74, whereby the roller cover 76 can be locked stably at this position (i.e. in the closed state as the position where the pressure is being applied).

Figure 15:
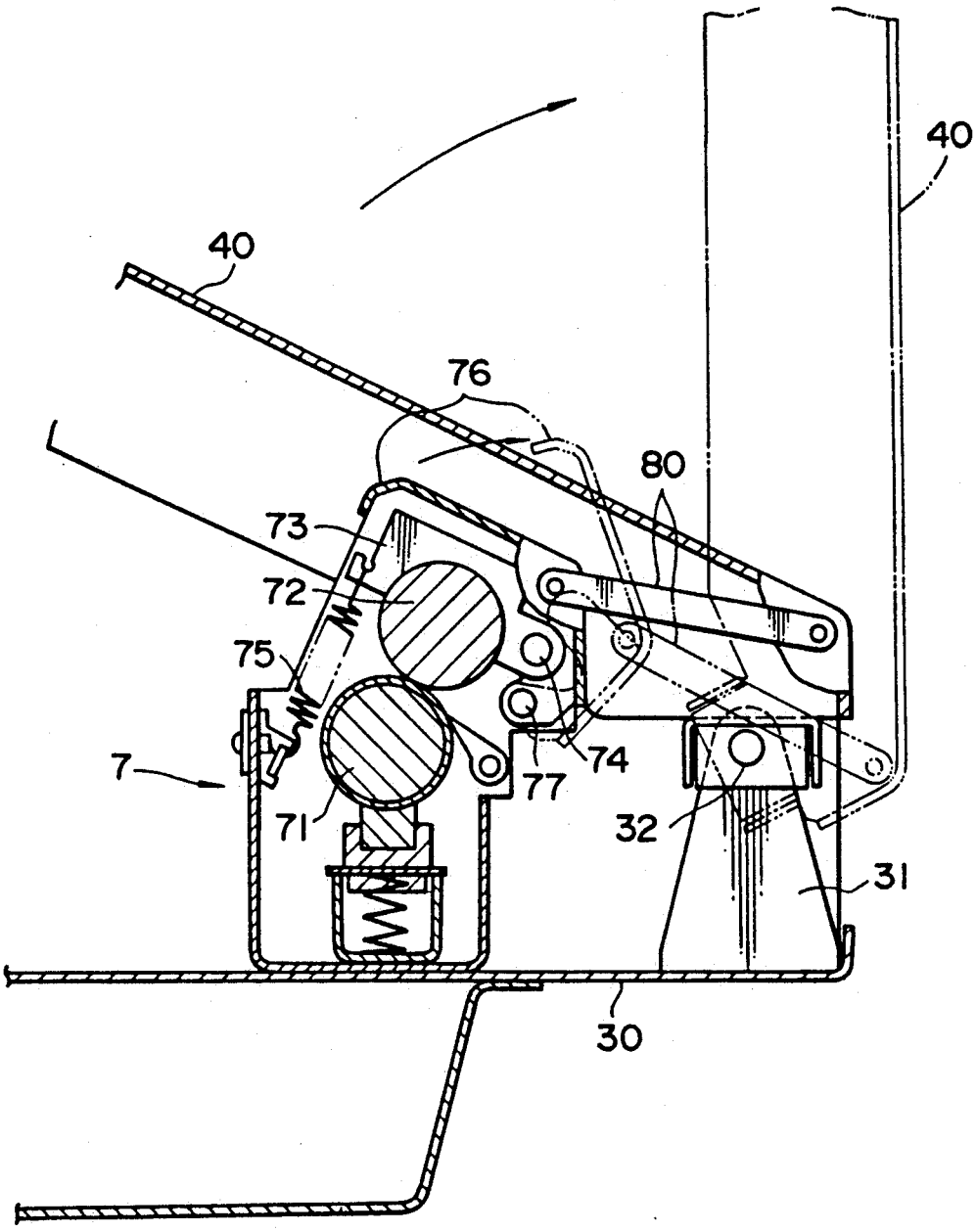
FIG. 15 is a schematic enlarged view of the fourth embodiment.

FIG. 15 shows an arrangement of the member forming the upper side of the recording paper feed path 12 of the laser beam printer of the fourth embodiment as an openable clamshell 40 so that the backup roller 72 is released from being forced to contact the heat roller 71 as the clamshell 40 is opened.

The lower end side of clamshell 40 is pivotally supported with a bracket 31 provided perpendicularly to a chassis 30 of the printer body by means of a shaft 32 and allowed to rock so that its upper side can be opened.

The predetermined position of the clamshell 40 and that of the roller cover 76 are coupled by means of a link 80 and the roller cover 76 is driven to rock and opened (i.e. the backup roller 72 is released from being forced to contact the heat roller 71) as the clamshell 40 is opened, whereas the backup roller 72 is forced to contact the heat roller 72 to make the fixing operation possible as the clamshell 40 is closed to open the roller cover 76.

With this arrangement, the backup roller 72 is released from being forced to contact the heat roller 71 simultaneously with the recording paper feed path being completely opened as the clamshell 40 is opened, so that the recording paper jammed in the fixing unit 7 becomes removable. In other words, the single operation of opening the clamshell 40 makes it possible to remove the recording paper jammed in the recording paper feed path and the fixing unit 7 during maintenance resulting from paper-jamming and maintenance can readily be implemented.

As set forth above, the press roller can be released from being forced to contact the heat roller by releasing the pressure regulating member according to the present invention. The recording paper jammed in between both the rollers can simply be removed and maintenance resulting from paper-jamming is facilitated.

What is claimed is:

1. An image recording apparatus employing an electrophotographic process to form a toner image on a recording medium, which comprises:

a body and a clamshell, one end of said clamshell pivoted to said body while the other end of said clamshell is movable away from said body;

a pair of fixing rollers for fixing said toner image onto said recording medium, said rollers in contact with each other under pressure;

release means for releasing at least one of said pair of fixing rollers away from the other of said pair of rollers;

wherein said release means is operated to release said at least one of said fixing rollers away from the other of said rollers in response to movement of said clamshell relative to said body;

said apparatus further comprising a support member for supporting said at-least-one of the fixing rollers, said support member being swingable in the direction that said at least one of said fixing rollers is removed away from the other said roller, said support member being biased so at least one of said fixing rollers has a neutral position located away from the other said roller;

wherein said support member has an end which is biased toward said other roller to cause said support member to swing in a direction that said at least one of said fixing rollers is moved away from said other roller;

a contact member swingable between an operative position, where a swing movement of said support member in the direction away from said other roller is prevented, and an inoperative position where said swing movement of said support member is allowed; and an operating member provided to set said clamshell so as to swing said contact member to its inoperative position when said other end of the clamshell is moved away from said body, wherein said operating member is a link member interconnected between said clam shell and said contact member.

2. The image recording apparatus of claim 1, wherein said support member further comprises a shaft and a cam which is connected substantially at an end of said shaft.

3. The image recording apparatus of claim 1, wherein said link member comprises a hook which is secured to said clamshell.

* * * * *